US006681541B2

(12) United States Patent
Wang Chen

(10) Patent No.: US 6,681,541 B2
(45) Date of Patent: Jan. 27, 2004

(54) FIREPROOF DOOR ASSEMBLY STRUCTURE

(75) Inventor: Kuei Yung Wang Chen, Taipei (TW)

(73) Assignee: Nan Ya Plastics Corporation, Taipei (TW)

( * ) Notice: Subject to any disclaimer, the term of this patent is extended or adjusted under 35 U.S.C. 154(b) by 132 days.

(21) Appl. No.: 09/900,201

(22) Filed: Jul. 9, 2001

(65) Prior Publication Data

US 2003/0005645 A1 Jan. 9, 2003

(51) Int. Cl.[7] ..... E06B 3/70
(52) U.S. Cl. ..... 52/455; 52/309.9
(58) Field of Search ..... 52/455, 284.11, 52/456, 459, 794.1, 232, 309.15; 49/501

(56) References Cited

U.S. PATENT DOCUMENTS

| | | | | | |
|---|---|---|---|---|---|
| 4,075,804 | A | * | 2/1978 | Zimmerman | 52/232 |
| 4,152,876 | A | * | 5/1979 | Seely | 52/455 |
| 4,367,614 | A | * | 1/1983 | Warwick | 52/455 |
| 4,550,540 | A | | 11/1985 | Thorn | |
| 4,572,865 | A | * | 2/1986 | Gluck et al. | 428/309.9 |
| 4,811,538 | A | * | 3/1989 | Lehnert et al. | 52/455 |
| 4,888,918 | A | * | 12/1989 | Green et al. | 49/501 |
| 4,896,471 | A | * | 1/1990 | Turner | 52/455 |
| 4,922,674 | A | * | 5/1990 | Thorn | 52/309.15 |
| 5,022,206 | A | * | 6/1991 | Schield et al. | 52/455 |
| 5,644,870 | A | | 7/1997 | Chen | |
| RE36,674 | E | * | 4/2000 | Gluck et al. | 428/308.4 |

FOREIGN PATENT DOCUMENTS

| | | | |
|---|---|---|---|
| EP | 583617 | * | 2/1994 |

* cited by examiner

*Primary Examiner*—Ramon O. Ramirez
*Assistant Examiner*—Tan Le
(74) *Attorney, Agent, or Firm*—Stevens, Davis, Miller & Mosher, LLP

(57) ABSTRACT

A fireproof door assembly structure includes two molded door panels of compression molded skins having outer surfaces of a wood-grain appearance and flat edges around their four sides. These molded door panels are overlaid with each other to form a door with a hollow core. A rectangular frame seals the door panels and coincides with the flat edges of the door panels. A reinforcing part is provided between the panels in an area for attaching a handle to the door panels. A fireproof material core is formed between the door panels to produce the fireproof door, and top, left, and right edges of the rectangular frame have a groove for receiving a fireproof strip therein.

1 Claim, 10 Drawing Sheets

FIREPROOF DOOR ASSEMBLY STRUCTURE

BACKGROUND OF THE INVENTION

1. Field of the Invention

The present invention relates to a fireproof door assembly and, more particularly, to a fireproof door assembly having fireproof material filled therein.

2. Description of the Related Art

U.S. Pat. No. 5,644,870 is typical of such door structures using two rectangular compression molded skins with each skin having an inside surface and an outside surface and, on its inside surface, a plurality of projecting parallel ribs along at least two of its edges, a hinge support having a plurality of grooves on its opposite sides with the grooves operable to interlock with the ribs of the skins along one side of the door when the skins are assembled with this support and an accessory support having a plurality of grooves on its opposite sides operable to interlock the ribs of the skins along the other side of the door when the skins are assembled therewith whereby no frame is required for the door when a foamed in place polyurethane core is formed between the skins. The door uses an interlocking member at its side and top edges and a preformed bottom panel or insert.

SUMMARY OF THE INVENTION

The invention in reference deals with four kinds of fireproof door assembly structures, "flat edge door," "interlock door," "intermediate fireproof board," and "double-board fireproof door" structure. The flat edge door structure comprising: two molded door panels of compression molded thin skins overlaid with each other to form door with a hollow core, said skins is flat edge around four sides; a rectangular frame sealing on said door panels operable to flat edge with said frame of the opposing panel when said panels are overlaid with one another; a reinforcing part located respectively between said panels in the area where the handle will be attached with said door panels; and a fireproof material core formed in place between said door panels to produce a real wood like fireproof door. The interlock door having interlocking members on their inner surface. The intermediate fireproof board structure having a fireproof board on the door center. The double-board fireproof door structure having two fireproof boards glue with door panels, and fireproof material filled into door.

DETAILED DESCRIPTION OF THE PREFERRED EMBODIMENTS

Figure 2:
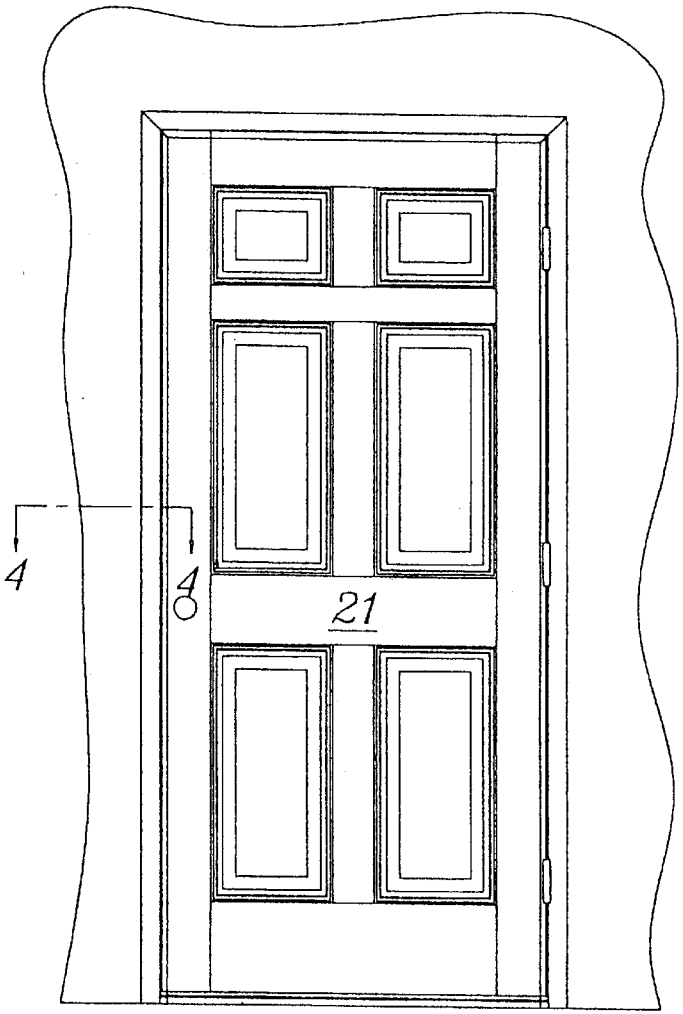
FIG. 2 is a front view of the interlock fireproof door pre-hung unit in accordance with a first embodiment of the present invention.
Figure 1:
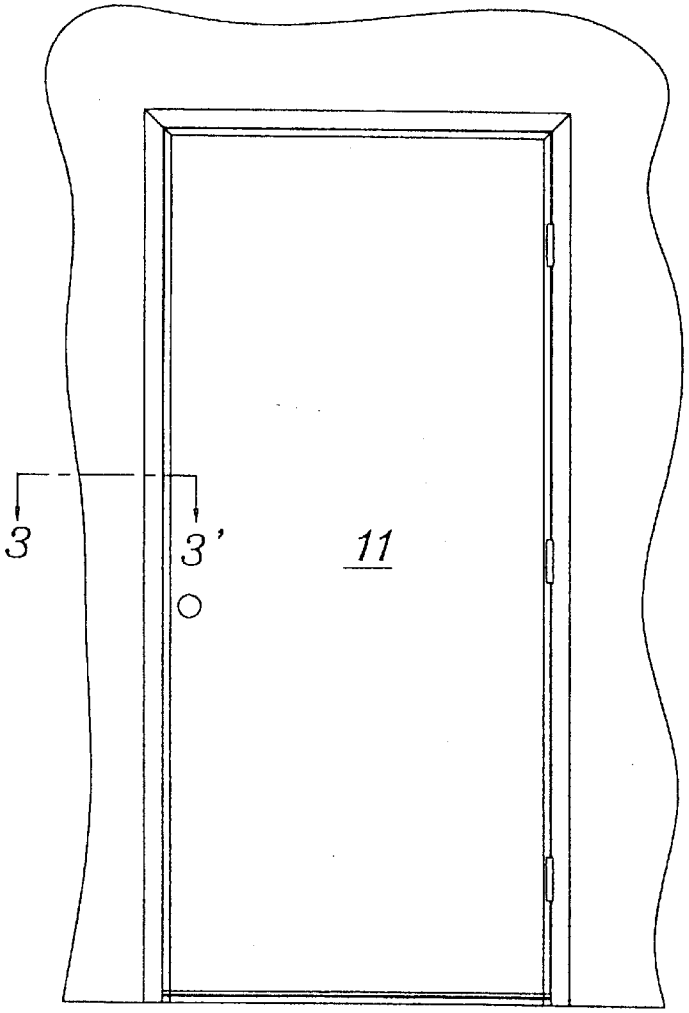
FIG. 1 is a front view of the flat edge fireproof door pre-hung unit in accordance with the second embodiment of the present invention.
Figure 3:
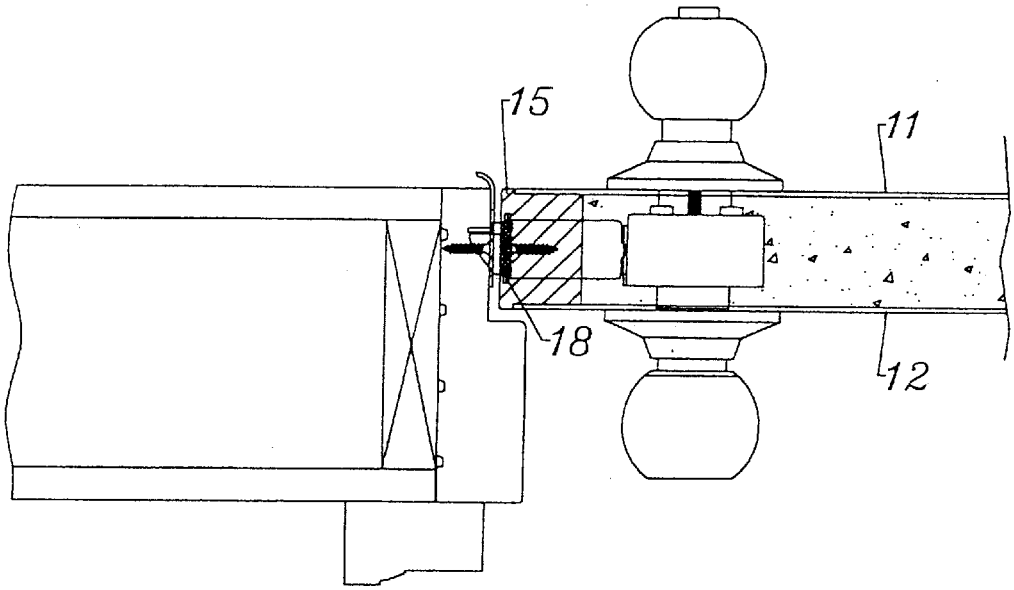
FIG. 3 is a section view of the flat edge fireproof door pre-hung unit in accordance with the second embodiment of the present invention.
Figure 4:
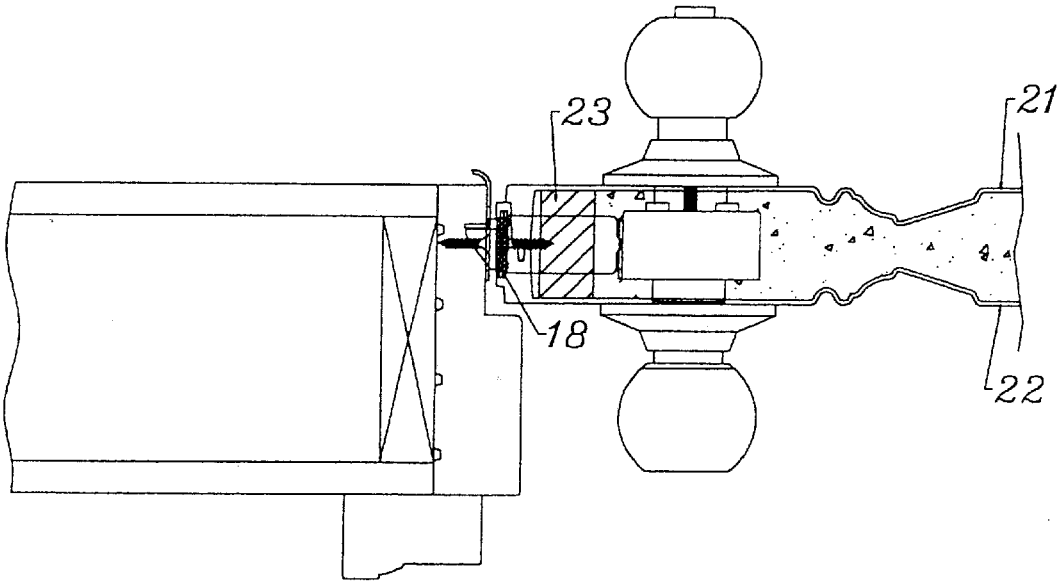
FIG. 4 is a section view of the interlock fireproof door pre-hung unit in accordance with a first embodiment of the present invention.
Figure 6:
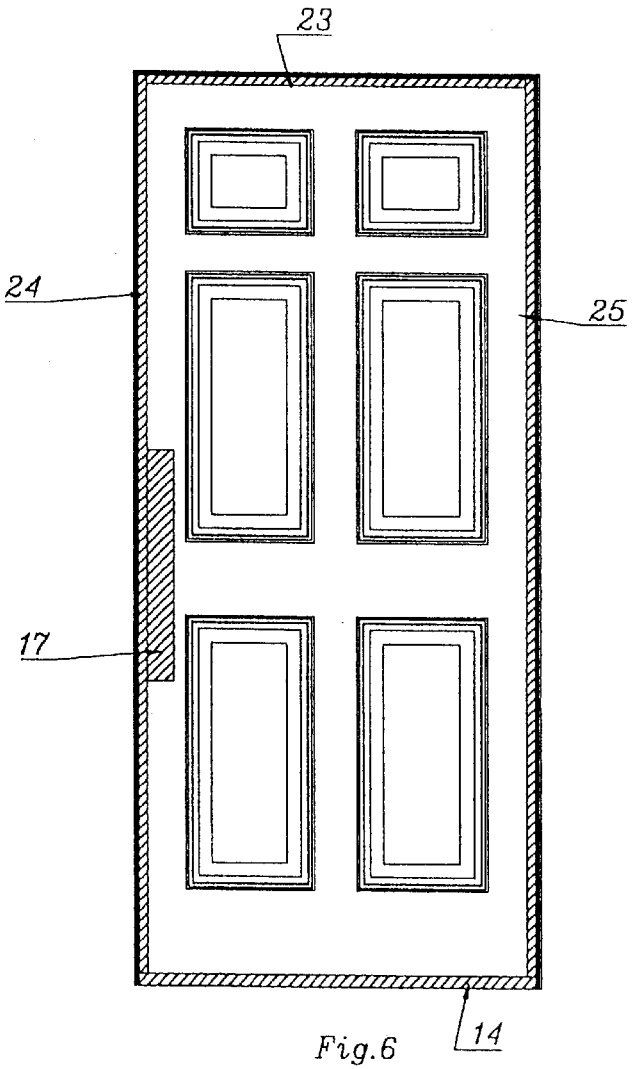
FIG. 6 is a front view of the interlock fireproof door assembly structure in accordance with a first embodiment of the present invention.
Figure 5:
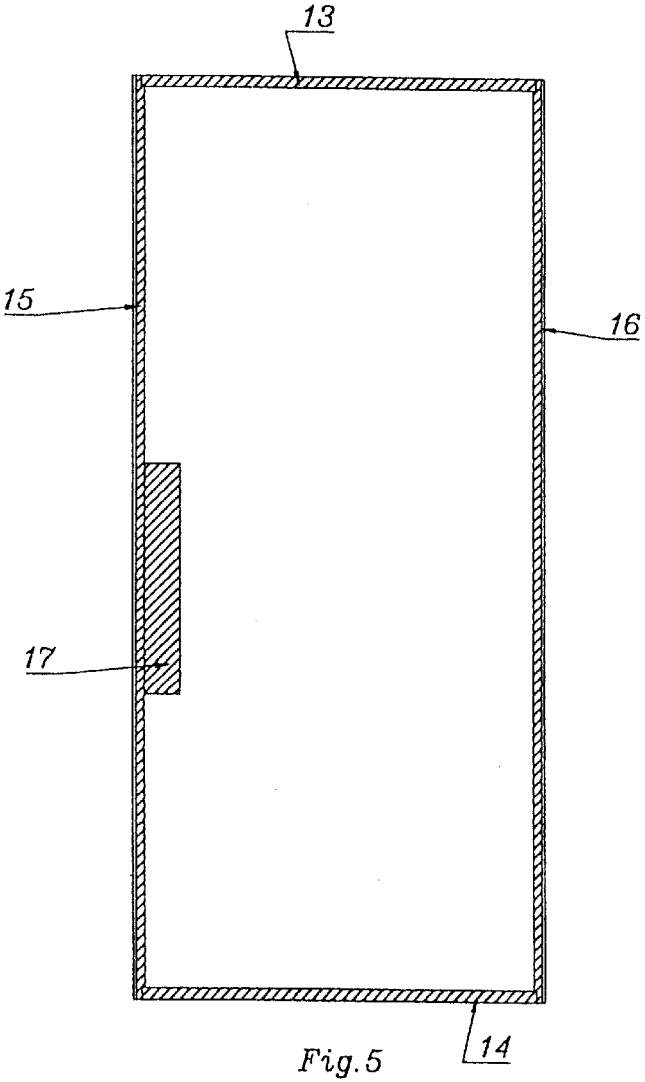
FIG. 5 is a front view of the flat edge fireproof door assembly structure in accordance with the second embodiment of the present invention.
Figure 7:
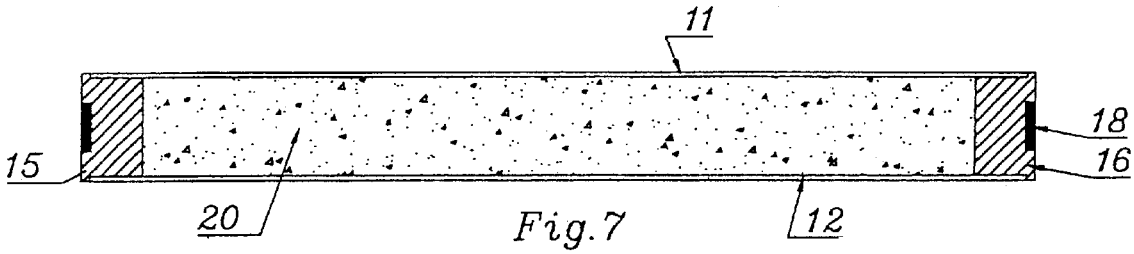
FIG. 7 is a horizontal section view of the flat edge fireproof door assembly structure in accordance with the second embodiment of the present invention.
Figure 8:
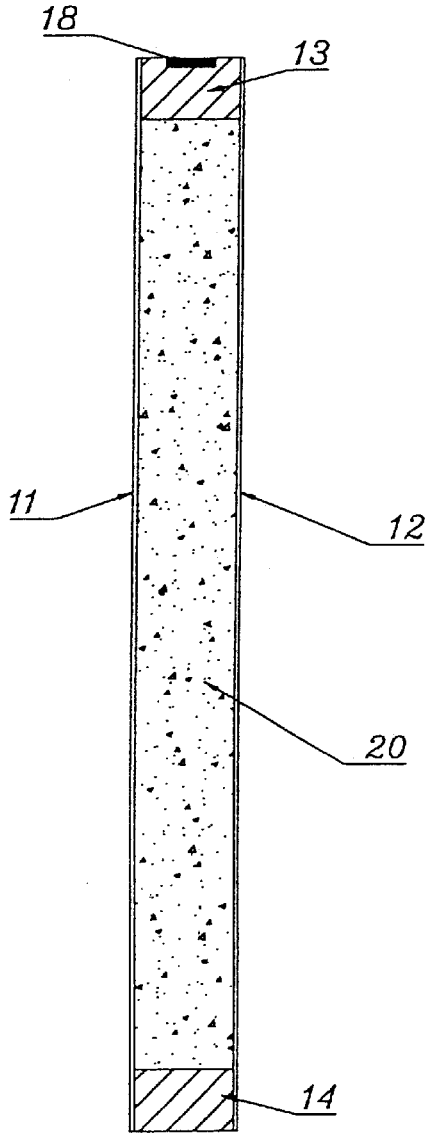
FIG. 8 is a vertical section view of the flat edge fireproof door assembly structure in accordance with the second embodiment of the present invention.
Figure 9:
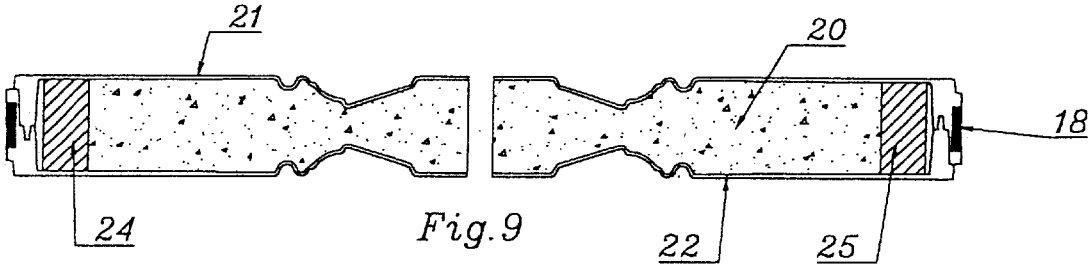
FIG. 9 is a horizontal section view of the interlock fireproof door assembly structure in accordance with a first embodiment of the present invention.
Figure 10:
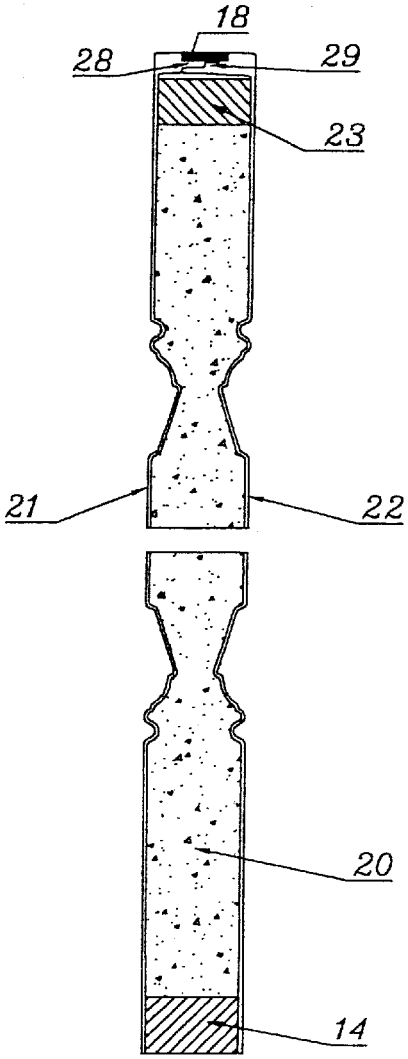
FIG. 10 is a vertical section view of the interlock fireproof door assembly structure in accordance with a first embodiment of the present invention.

The invention in reference deals with four kinds of fireproof door assembly structures, "flat edge door," "interlock door," "intermediate fireproof board," and "double-board fireproof door" structure.

A fireproof door assembly in accordance with the first embodiment of the present invention comprises a first door skin 11, a second door skin 12, the top and bottom frame elements 13, 14, the left, right sealing frame material 15, 16, a handle reinforcement material 17, a fireproof strip 18 (refer to FIGS. 1, 3, 5, 7, 8). The thickness of the first door skin 11 and the second door skin 12 is about 1 to 4 mm and the four edges of each door skin are smooth surfaces for tightly adhered to the rectangular frame 13, 14, 15, 16. The door skins 11 and 12 are made of the material selected from sheet molding compound of glass fiber, wood, and steel. The front surface of the door skins 11, 12 can be smooth surface or with wood grain and the backside of the door skins 11 and 12 should be rough surface for increasing the adherence ability. The rectangular frame is made of the material selected from PVC foam profile, wood, steel or injected plastics.

The assembly sequence of the invention is: the rectangular frame 13, 14, 15, 16 are mounted to the edge of the first door skin 11 by the adhesive, and the reinforcement member 17 is disposed at the lock position to enhance the mechanical strength around the lock portion. Two ends of the left frame 15 and the right frame 16 have recessions to receive the end of the top frame 13 and the bottom frame 14 while assembling to form a cabin there between. The bottom frame 14 is then drilled with a hole through which the fireproof material 20 is filled into the cabin. The fireproof material 20 further comprises a hardening agent such that the fireproof material 20 will be solidified in the cabin between the door skins 11 and 12 to block the fire frame. When on fire, the door skins 11, 12 will burn away, however, the fireproof material 20, including phenol and formaldehyde, will not burn up and thus forms a block wall for the fire.

The fireproof material 20 mainly comprises phenol and formaldehyde that are mixed to form phenol-formaldehyde resin. The fireproof material 20 further comprises hardening agent, such as acid, vesicant, such as dichloromethane or pentane, and agglutinating agent, such as polyvinyl acetate or magma. The proportion of compound in the fireproof material 20 is as follow:

Compound 1: 35%~45% by weight of phenol;

Compound 2: 35%~45% by weight of formaldehyde;

Hardening agent: 10%~30% by weight of acid;

Vesicant: 0.01%~2% by weight of dichloromethane or pentane; and

Agglutinating agent: 1%~5% by weight of polyvinyl acetate or magma.

Figure 11:
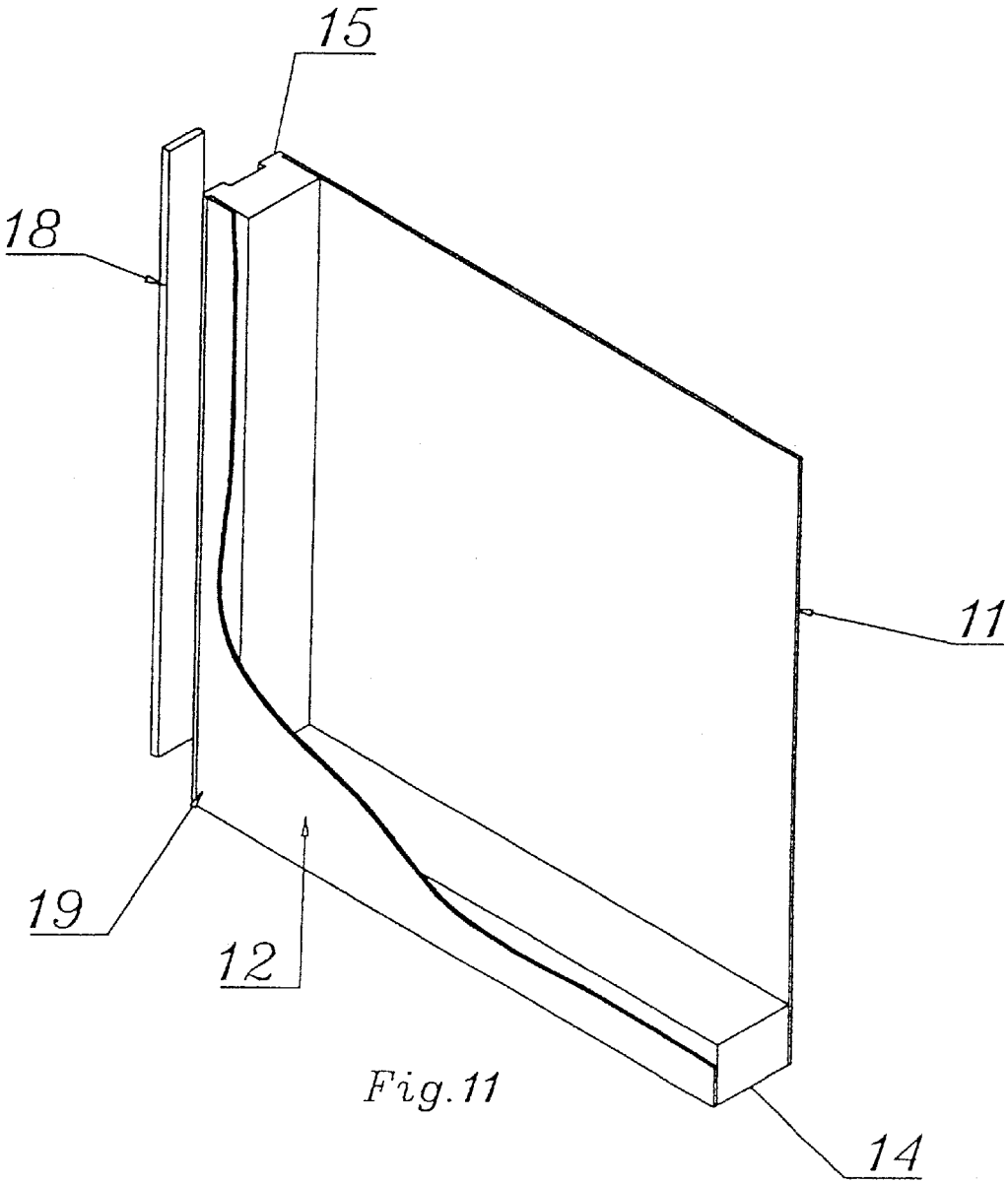
FIG. 11 is an exploded perspective view of the flat edge fireproof door assembly structure in accordance with the second embodiment of the present invention.

Referring to FIG. 11, in order to block smoke and flame of the fire to flow through a gap between the door and the door jamb, the top frame 13, the left frame 15 and the right frame 16 have a groove therein so as to receive the fireproof strip 18. The fireproof strip 18 seals the gap between the door and the doorjamb while closing the door.

A fireproof door assembly in accordance with the second embodiment of the present invention comprises a first door skin 21, a second door skin 22, a top reinforcement frame 23, a bottom frame 14, a left reinforcement frame 24, a right reinforcement frame 25, a handle reinforcement member 17, a fireproof strip 18 (refer to FIGS. 2, 4, 6, 9, 10). The left edge and the right edge of the door skins 21, 22 are provided with a rib 26 and a groove 27 respectively, and the top edge of the door skins 21, 22 are provided with another rib 28 and groove 29 respectively. The top reinforcement frame 23, the bottom frame 14, the left reinforcement frame 24 and the right reinforcement frame 25 together define a cabin between the edge of the first door skin 21 and the second door skin 22. The thickness of the first door skin 21 and the second door skin 22 is about 1 to 4 mm and the four edges of each door skin are smooth surfaces for tightly adhered to the rectangular frame 23, 14, 24, 25. The door skins 21 and 22 are made of the material selected from sheet molding compound of glass fiber, wood, and steel. The front surface of the door skins 21,22 can be smooth surface or with wood grain and the backside of the door skins 21 and 22 should be rough surface for increasing the adherence ability. The rectangular frame is made of the material selected from PVC foam profile, wood, steel or injected plastics.

The assembly sequence of the invention is: the rectangular reinforcement frame 23, 14, 24, 25 are mounted to the edge of the first door skin 21 by the adhesive, and the reinforcement member 17 is disposed at the lock position to enhance the mechanical strength around the lock portion. The ribs 26, 28 are respectively attached to the grooves 27, 29 with the adhesive. The bottom frame 14 is then drilled with a hole through which the fireproof material 20 is filled into the cabin. The fireproof material 20 further comprises a hardening agent such that the fireproof material 20 will be solidified in the cabin between the door skins 21 and 22 to block the fire frame. When on fire, the door skins 21, 22 will burn away, however, the fireproof material 20, including phenol and formaldehyde, will not burn up and thus forms a block wall for the fire.

The fireproof material 20 mainly comprises phenol and formaldehyde that are mixed to form phenol-formaldehyde resin. The fireproof material 20 further comprises a hardening agent, such as acid, vesicant, such as dichloromethane or pentane, and agglutinating agent such as polyvinyl acetate or magma. The proportion of compound in the fireproof material 20 is as follow:

Compound 1: 34%~45% by weight of phenol;

Compound 2: 34%~45% by weight of formaldehyde;

Hardening agent: 10%~30% by weight of acid;

Vesicant: 0.01%~2% by weight of dichloromethane or pentane; and

Agglutinating agent: 1%~5% by weight of polyvinyl acetate or magma.

Figure 12:
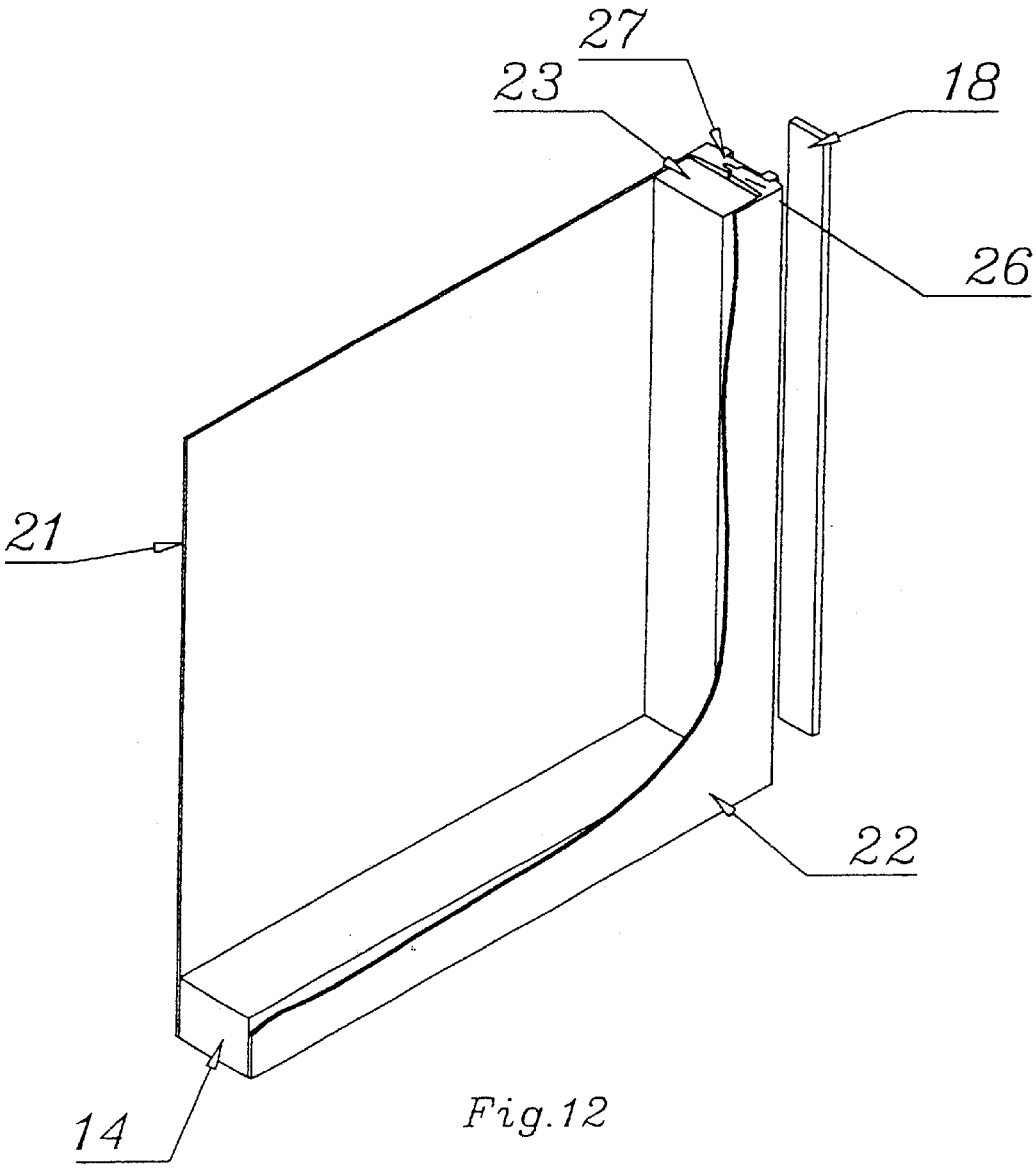
FIG. 12 is an exploded perspective view of the interlock fireproof door assembly structure in accordance with a first embodiment of the present invention.

Referring to FIG. 12, in order to block smoke and flame of the fire to flow through a gap between the door and the door jamb, the interlock edge of the door skins 21, 22 have a groove 27 therein so as to receive the fireproof strip 18. The fireproof strip 18 seals the gap between the door and the door jamb while closing the door.

Figure 13:
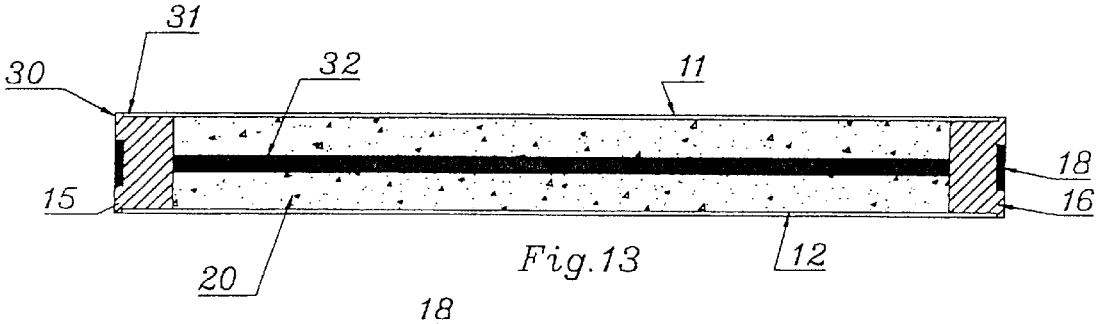
FIG. 13 is a horizontal section view of the intermediate fireproof board door assembly structure in accordance with the third embodiment of the present invention.
Figure 14:
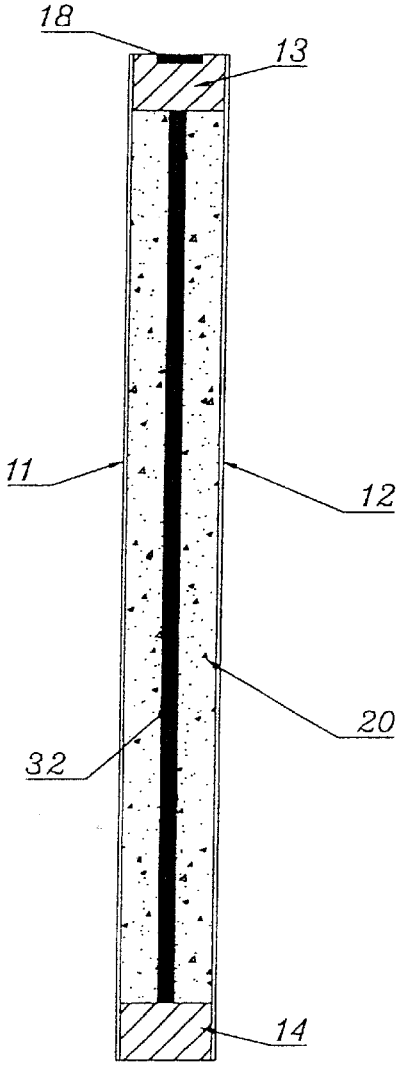
FIG. 14 is a vertical section view of the intermediate fireproof board door assembly structure in accordance with the third embodiment of the present invention.

A fireproof door assembly in accordance with the third embodiment of the present invention to constituting the fireproof door structure, having the fireproof door with an intermediate board featuring: two door skins 11, 12, the top and bottom opposing frame 13, 14, the left, right frame 15, 16, a handle reinforcement material 17, a fireproof strip 18 and the fireproof board 32 (refer to FIGS. 13, 14).

The door skins 11, 12 being of thickness varying between 1~4 mm and the rim in the form of a flat board for successful assembly of the top, bottom, left and right frame 13, 14, 15, 16 in tight bonding. Said sealing rectangular frame material is made of PVC foam profile, wood, or steel.

The door skins 11, 12, of the invention in question, are made of sheet molding compound, wooden door skin, steel or solid door panels. The coating may be smooth without line or imitation line of depth of between 0.05 to 0.2 mm. Said skin has a rough coating, for additional friction when bonding the door panel.

Said intermediate partition board 32 is made of oxide magnesium, gypsum or mineral cement, with fireproof properties.

The assembly sequence of the invention is: first apply glue on the sealing rectangular frame and the door panels with insertion of a reinforcement material at the handle, for additional resistance of the handle when locking; then place 4~6 small pieces of pad wood in average (of W5 cm*H5 cm*T1.9 cm) on the panel to support the fireproof board 32. After mounting the fireproof board, place small pieces of pad wood on the fireproof board, to support the door skin of the other side, being the left and right seal duly adapted by means of the ribs and the panels; the upper and lower sealing material are duly positioned by means of the milled upper and lower notch 19 on the left and right sealing material, for forming a concealed and hollow door panel space, before eventually perforating 2 holes on the lower sealing side, on each side of the intermediate partition board 32. Fill in phenolic aldyhyde foam fireproof substance 20 inside the door.

Figure 15:
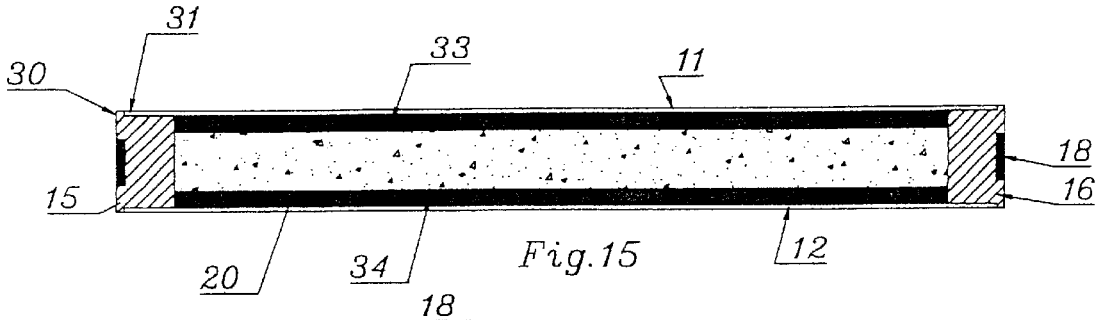
FIG. 15 is a horizontal section view of the double-board fireproof door assembly structure in accordance with the fourth embodiment of the present invention.
Figure 16:
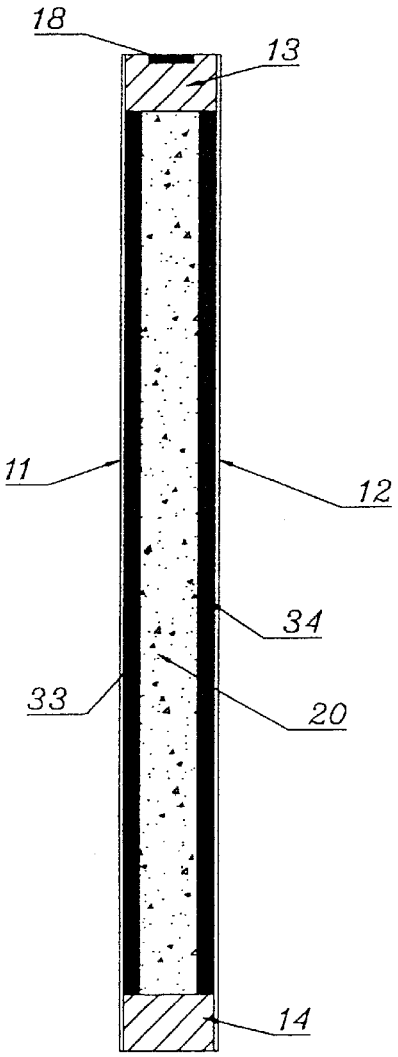
FIG. 16 is a vertical section view of the double-board fireproof door assembly structure in accordance with the fourth embodiment of the present invention.

A fireproof door assembly in accordance with the fourth embodiment of the present invention. The double-board fireproof door structure comes with: 2 pieces of door skins 11, 12, top and bottom frame 13, 14, left and right frame 15, 16, a handle reinforcement 17, a smoke strip 18 and a fireproof board 33, 34 (refer to FIGS. 15, 16).

The assembly sequence of the double-board fireproof door is: first bond the fireproof board 34 and the door skin 12 together; then bond the fireproof board 33 and the door skin 11 together. Mount the sealing angular materials and the single-sided door panel (glued to the fireproof panel) with glue, with insertion of a reinforcement material to the handle, for additional resistance of the handle when locking. Then place 4~6 small pieces of pad wood in average (of W5 cm*H5 cm*T3.5 cm) on the fireproof board to support the panel on the other side. Adapt the left and right frame by means of the ribs and the panels; the top and bottom frame are duly positioned by means of the milled top and bottom notch 19, forming a concealed and hollow door panel space; and eventually perforating 1 hole on the lower sealing side, and fill in phenolic aldyhyde foam fireproof substance 20 inside the door.

The invention in reference features phenolic aldyhyde foam filled in the fireproof panel, for long-time fireproof performance, requiring a patent.

Figure 17:
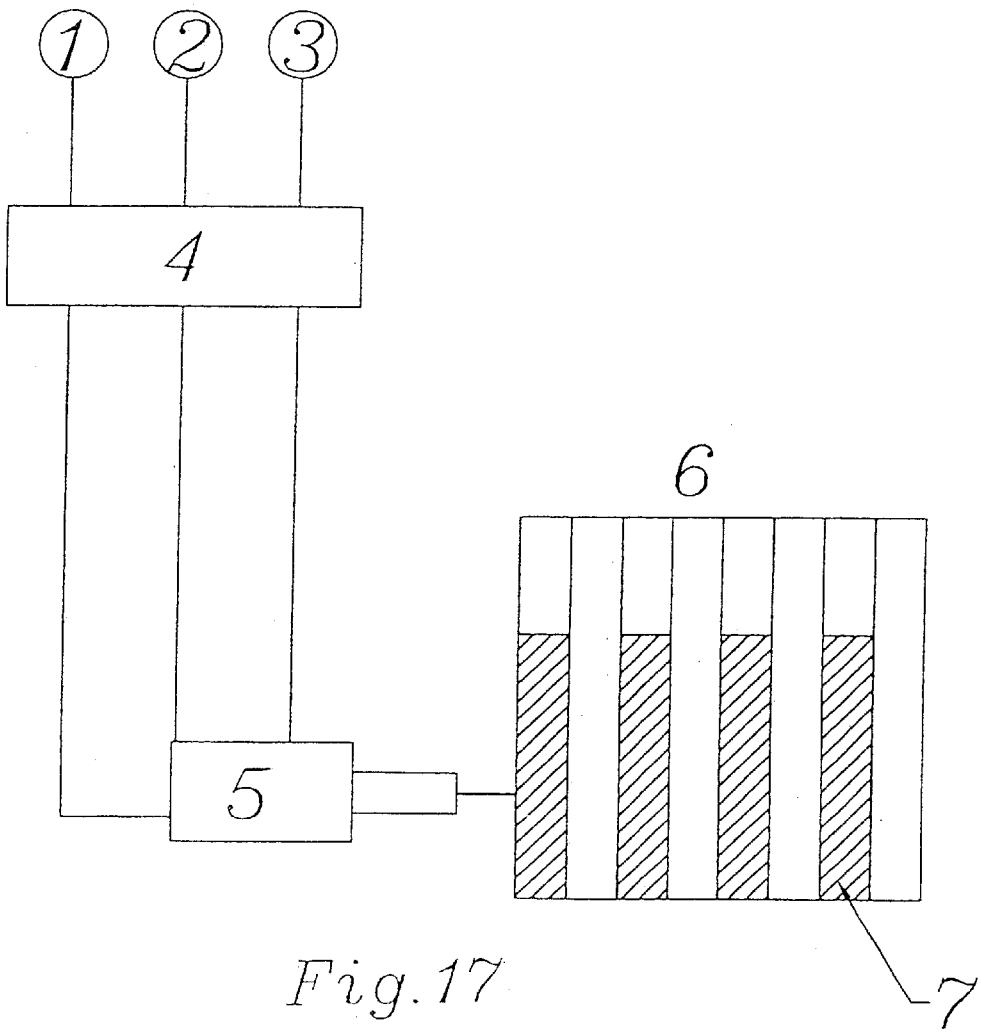
FIG. 17 is a manufacturing process view of the phenolic aldyhyde foam.

An additional description on the phenolic aldyhyde foam is given as follows (refer to FIG. 17). The invention in reference has phenolic foam as stuffed material in the fireproof door, for optimal fire-retardant property, low-smoke structure and optimal construction. In case of fire, the optimal fire-retardant property would keep off flame and high temperature, providing safety both people and material, while minimizing loss in material. The low-smoke performance would reduce toxicity or suffocation, for evacuation.

The stuffing in the fireproof door in the invention in reference is phenolic foam, of 2-liquid or 3-liquid in individual tanks for mixture, before filling for even mixture into the fireproof door for stuffing. The stuffed door is then tightened by a press in a temperature range of 25° C.~50° C. for 10~30 minutes, until phenolic foam is fully hardened.

The phenolic foam of the invention in reference has the following ingredients and preparation. The resin used in this invention is a reactive resin of low smoke and optimal fire-retardant property, such as a phenolic foam formed with trioamonium nitride plus urea, in 100 phr. Its preparation may be of 2-liquid or 3-liquid, of which the use and preparation are given in the following:

Liquid 1: add in 0~30 phr of (1) water in resin to regulate the viscosity of the resin and control the foaming reaction, and (2) 0.5~3.0 phr of silicone surfactant to improve the structure of the foam body, for optimal density, using silicone glycol copolymer; (3) phosphorous, nitrogen fire retardant for optimal fireproof property, using ammonium polyphosphate, melamine polyphosphate, pentaerythril, melamine, partial phosphate ester in 0~30 phr; (4) adding in 1~12 phr of physical foams, using liquid foam such as HCFC and pentane having a boiling point of between 25° C.~80° C.

Liquid 2: Using hardeners such as mineral acid or irreplaceable sulfuric acid in amount depending on density and acidity and in 2~60 phr.

Liquid 3: powder chemical foams of 90° C.~140° C. in temperature, of azobisisobutyronitrile, AIBN, diazoamino benzene, benzene sulfonyl hydrazide, p-toluene sulfonyl hydrazide among others in 1~10 phr. When using chemical foams, add in solvent first to have the powder foams be liquid for successful filling for mixture.

Preparation and filling of the ingredients in the invention in reference may be of 2- or 3-liquid. The 2-liquid filling is to have the properly mixed liquid 1 and liquid 2 pumped from the ingredient bucket into the 2-liquid high (low) pressure mixer, for a high-speed mixing in the filling machine and filling into the assembled hollow door; the 3-liquid filling differs from the 2-liquid filling mainly by the different foam, using the 2-liquid physical foam and the 3-liquid chemical foam. The 3-liquid filling is to have liquid 1 (without physical foam), liquid 2 and liquid 3 be pumped from the individual bucket into the 3-liquid high (low) pressure mixer, by controlling the dosage and for high-speed mixing in the filling machine before filling into the assembled hollow door, for full hardening of the phenolic foam, before removal. FIG. 17 shows the filling unit of phenolic foam:

(1) Liquid 1 preparation bucket;

(2) Liquid 2 preparation bucket (hardener bucket);

(3) Liquid 3 preparation bucket (chemical foam bucket);

(4) Raw material convey metering pump;

(5) Phenolic foam injector;

(6) Phenolic foam filling machine body (refer to Cannon PU Foam high/low pressure filling machine similar machines injector for similar units); and (7) Partition panel.

What is claimed is:

1. A fireproof door assembly structure, comprising:

two molded door panels of compression molded skins overlaid with each other to form a door with a hollow core, said skins being flat edged around their four sides;

a rectangular frame sealing on said door panels operable to flat edge with said frame of the opposing panel when said panels are overlaid with one another;

a reinforcing part located respectively between said panels in an area for attaching a handle to said door panels; and a fireproof material core formed in place between said door panels to produce the fireproof door, wherein the top, left and right edge of said rectangular frame have a recess for receiving a fireproof strip therein.

* * * * *